US012053856B2

(12) United States Patent
Weber

(10) Patent No.: US 12,053,856 B2
(45) Date of Patent: Aug. 6, 2024

(54) APPARATUS FOR MACHINING FLAT WORKPIECES

(71) Applicant: Georg Weber, Kronach (DE)

(72) Inventor: Georg Weber, Kronach (DE)

( * ) Notice: Subject to any disclaimer, the term of this patent is extended or adjusted under 35 U.S.C. 154(b) by 450 days.

(21) Appl. No.: 17/361,583

(22) Filed: Jun. 29, 2021

(65) Prior Publication Data

US 2022/0355433 A1 Nov. 10, 2022

(51) Int. Cl.
*B24B 7/07* (2006.01)

(52) U.S. Cl.
CPC ..... *B24B 7/075* (2013.01)

(58) Field of Classification Search
CPC ..... B24B 7/075; B24B 37/013; B24B 49/04; B24B 49/16; B24B 7/228; B24B 27/0023; B24B 27/0076; B24B 37/10; B24B 49/003; B24B 49/03; B24B 49/12; B24B 49/02; B24B 47/12
See application file for complete search history.

(56) References Cited

U.S. PATENT DOCUMENTS 1,138,683 A 5/1915 Murray
3,874,123 A 4/1975 Hopkins
5,458,533 A * 10/1995 Barth ..... B24B 23/03 451/344
2002/0090889 A1* 7/2002 Crevasse ..... B24B 37/013 451/41
2004/0058629 A1* 3/2004 Weber ..... B24B 9/002 451/260

FOREIGN PATENT DOCUMENTS

CN 107234509 A * 10/2017
CN 109202650 A * 1/2019 ..... B24B 27/0076
DE 2307095 A1 8/1974
DE 10338682 B4 4/2004
DE 202007019301 U1 10/2011
DE 102017110950 A1 11/2018
EP 2190626 B1 1/2013
TW I601597 B * 10/2017

* cited by examiner

*Primary Examiner* — Eric J Rosen
*Assistant Examiner* — John C Merino
(74) *Attorney, Agent, or Firm* — McGarry Bair PC

(57) ABSTRACT

An apparatus for machining flat workpieces has at least two tool carriers mounted to machining heads that are drivable by at least a first drive unit. The tool carrier of one machining head is arranged such that it is movable in a shifting range (V1) along a first axis relative to the carrier unit. The tool carrier of a second machining head is arranged such that it is movable in a shifting area (V2) along the first axis relative to the carrier unit.

15 Claims, 10 Drawing Sheets

APPARATUS FOR MACHINING FLAT WORKPIECES

CROSS-REFERENCE TO RELATED APPLICATIONS

This application claims priority to Germany application DE 10 2021 111 672.4, filed May 5, 2021.

TECHNICAL FIELD

The invention relates to an apparatus for machining flat workpieces, said apparatus having a machine frame comprising a workpiece support and at least one carrier unit positionable relative to the workpiece support. The apparatus further has a first and at least a second machining head, each machining head being connected to the carrier unit. Each machining head comprises a tool carrier which is rotatably mounted on the carrier unit about a first axis perpendicular to the workpiece support and which carries at least one tool that is mounted on the tool carrier eccentrically to the first axis rotatably about a second axis perpendicular to the workpiece support surface and is connected to a planet wheel. The planet wheel is gear-engaged with a sun wheel that is coaxial to the first axis. The tool carriers of the machining heads are drivable by at least a first drive unit.

Known apparatuses for machining flat workpieces are often configured such that the distance between the machining tools and a workpiece support for supporting the workpiece to be machined is preferably adjustable by a motor. Thus, from document DE 10 2017 110 950 A1, it is known that in the case of grinding machines the distance between the individual grinding brushes on the one hand and a conveying device on the other hand is adjustable. This makes it possible to react to workpieces of different thicknesses and moreover to adjust a contact pressure or grinding pressure of the individual grinding brushes on the surface to be ground. Further, grinding machines are known, in which this adjustment takes place automatically in a sensor-controlled manner.

In such known grinding machines, the distance of all machining heads or all tools is changed simultaneously. In particular, in the case of uneven flat workpieces a relatively large distance to the workpiece has to be kept, and it may happen that then individual areas of the workpiece are no longer contacted by the tools and thus are not machined. In addition, for example from document DE 103 38 682 B4, a grinding apparatus having planetary grinding heads is known, in which an adjustment device for the simultaneous height adjustment of all grinding brushes of the planetary head is provided at the tool carrier of the planetary head itself.

BACKGROUND

From document U.S. Pat. No. 3,874,123 A, a planetary grinder for workpieces is known. The planetary grinder has several grinder units with one rotatable grinding element each. Each grinder unit has a separate drive unit for adjusting the height of the respective grinding element relative to the workpiece. For this, the height of the workpiece to be machined in the machining area of the grinding element must be known exactly so that, in particular in the marginal region of the workpiece to be machined, no collision between grinding element and workpiece occurs.

When cutting plate-shaped or flat metal pieces by flame-cutting or similar machining processes, the flat workpieces produced in this way may distort so that they do not present an even surface to be machined. When the uneven surface structure of the workpiece to be machined exceeds a certain level, in particular the tolerances specified for this in the DIN, there is a risk that tools are damaged during machining of the workpiece and/or surface areas of the workpiece are not sufficiently machined, in particular are not contacted, by machining tools.

It is the object of the invention to specify an apparatus for machining flat workpieces with the aid of planetary heads, in which also uneven flat workpieces may be machined in a reliable manner.

BRIEF DESCRIPTION

This object is solved by an apparatus having the features of claim 1. Advantageous embodiments are specified in the dependent claims.

In particular by the fact that in the apparatus for machining flat workpieces according to claim 1 both the tool carrier of the first machining head and the tool carrier of the second machining head are each arranged such that they are arranged movably relative to the carrier unit within a shifting range along the first axis, the distance of the tool carriers relative to the surface of the workpiece to be machined can be adapted, and indeed independently of the position of the tool carrier of the further machining head or the further machining heads. Due to the possibility of a shifting along the first axis of the respective machining head, a positioning of all tools of the respective head takes place so that also when machining the marginal area of the workpiece, given a corresponding control, the tool carrier is only moved in the direction of the workpiece when the workpiece is located in the machining area of the respective machining head, preferably covers 50% of the machining area. As a result, a bumping of individual tools against the workpiece edge is prevented. Further, the tools may be pressed against the surface of the flat workpiece to be machined with a predetermined pressure force, in particular by the weight of the tool carrier and the elements connected thereto and/or by the pressure force of a drive unit.

Flat or plate-shaped workpieces include all workpieces, the sides of which facing the machining heads have a surface that can be machined with the aid of the respective tools of the machining heads. The surface of the workpiece to be machined does not have to be parallel to the workpiece support, at least not in all areas, but may also have curved or wavy areas. In particular, sheet metal cuttings or stored woods may be distorted or warped and may not have a surface that is exactly parallel to the workpiece support. By the apparatus of claim 1, more surface irregularities may be leveled out than can be leveled out by the tools of the machining heads themselves.

Preferably, the shifting of the second machining head in the shifting range of the second machining head along the first axis relative to the carrier unit is independent of the shifting or the shifting position of the tool carrier of the first machining head. As a result, an easy adjustment of the position of the machining heads to the surface of the flat workpiece to be machined is possible.

Further, it is advantageous when the sun wheel of the respective machining head is arranged on the carrier unit in a rotationally fixed manner. Preferably, the tool carriers of all machining heads are arranged movably along the respective first axis so that an adjustment to the course of the surface of the flat workpiece to be machined is easily possible over the entire machining width of the apparatus for machining flat workpieces. The tools are preferably knock-off tools, in particular for knocking off slag, grinding tools for grinding the surface to be machined of the flat workpiece and/or brushing tools for brushing the surface of the flat workpieces to be machined. With the aid of the knock-off tools, also glue residues may be removed from wooden workpieces, in particular from glued woods.

By the possibility of moving the machining heads in the respective shifting range the machining heads may follow the surface course of the workpiece and may in particular evade when the distance between the carrier unit and the workpiece surface in the machining area of the respective machining head is reduced. As a result, greater differences in height in the surface course may be leveled out than in the case of apparatuses having no individually movable machining heads, in which differences in height, if at all, may only be leveled out by the tools. Thus, for example, brushing tools or tools which each comprise an abrasive body and a plurality of abrasive discs that are arranged in radial planes including the cylinder axis and the axis of rotation of the cylindrical abrasive bodies enable a height difference compensation of several millimeters.

It is particularly advantageous when the direction of rotation of the first drive unit is changeable so that a machining of the flat workpieces adapted to the requirements is easily possible. By changing the direction of rotation, in particular the service life of knock-off tools and/or brushing tools can easily be extended.

Further, it is advantageous when the respective machining head is configured and arranged such that the tools machine the underside of a workpiece resting on a workpiece support. Alternatively, the machining heads may each be configured and arranged such that the tools machine the upper side of a workpiece resting on the workpiece support.

It is particularly advantageous when a second drive unit is allocated to each machining head, which second drive unit is configured to shift the tool carrier of the respective machining head within the respective shifting range. In particular the respective second drive unit may shift the tool carrier along the shifting range into the position remote from the workpiece and then, when a workpiece reaches the machining area of the respective machining head and covers a preset area of the respective machining area, it may be moved in the direction of the workpiece.

It is particularly advantageous when a first sensor unit is provided, which is configured to detect the presence of a workpiece to be machined and/or the arrival of a workpiece to be machined and/or the distance of the surface to be machined of a workpiece to be machined to the workpiece support in the machining area of a machining head and to generate a corresponding sensor information and to transmit it to a control unit. As a result, it is possible to detect the arrival or the presence of the workpiece in the machining area and/or the course of the surface of the workpiece and to take it into account in the control of the machining heads. As an alternative to the first sensor unit, corresponding information about the geometry of the workpiece to be machined may be provided to the control unit, in particular by transmitting corresponding data from a data source and/or by an input via an input unit, for example by a user.

It is particularly advantageous when the control unit is configured to control the second drive units of the machining heads based on the sensor information of the first sensor unit such that at least a part of the tool or a part of the tools of the respective machining head contact the surface to be machined of the workpiece to be machined present in the machining area of the machining head. This guarantees a safe and high-quality machining of the workpiece to be machined.

The first sensor unit may in particular comprise an optical sensor, such as a light barrier, a light sensor, a laser distance measuring unit, an inductive sensor, a Reed sensor and/or a mechanical switch. This enables an easy and cost-efficient detection of the workpiece for controlling the second drive unit. Alternatively, the sensor unit may also comprise a camera which detects at least the outer shape of the flat workpiece to be machined and generates corresponding sensor information, the control unit controlling the second drive units based thereon.

It is particularly advantageous when the machining heads are brought into a machining position by a positioning of the carrier unit and/or by a corresponding control of the second drive units. Due to the machining position, the machining heads have a preset distance to the workpiece support and/or are brought into contact with the workpiece. The contact with the workpiece may be determined in particular with the aid of a sensor unit, e.g. with a current measuring unit for determining the current consumption, or with the aid of a sensor unit for detecting the torque of a drive motor of the first drive unit. During the machining of the workpiece to be machined this sensor information, i.e. the current consumption or the torque of the drive motor, may be used to control the second drive unit and/or a further drive unit for changing the position of the carrier unit accordingly.

It is particularly advantageous when the shifting range of the respective tool carrier is limited by a range of adjustment of the respective second drive unit. This enables an easy limitation of the shifting range.

It is particularly advantageous when each of the second drive units is a pneumatic drive unit. In the case of such a pneumatic drive unit, the pressure force may be adjusted particularly easily and in the case of an increase in the counter force by the workpiece to be machined, in particular as a result of a reduction of the distance of the workpiece surface relative to the carrier unit, the pressure force may be set easily and limited with the aid of the pneumatic drive unit so that the tool carrier may follow the course of the surface of the workpiece to be machined.

It is particularly advantageous when the first sensor unit determines the course of the surface and/or the shape of a portion of the workpiece to be machined entering the machining area of a machining head and when the control unit is configured to control the second drive unit of the respective machining head based on the determined course, wherein the control unit is preferably configured to control the second drive unit of a machining head such that a preset distance between the tool carrier and the surface to be machined is not fallen below, in particular kept to the preset distance when the portion enters the machining area of the machining head. Here, the tool carrier may be moved away from the workpiece when the distance between the surface to be machined and the tool carrier is reduced. Further, the respective tool carrier may be moved toward the workpiece when the distance between the surface to be machined and the tool carrier is increased. As a result, the position of the respective machining head is easily adapted to the course of the surface of the workpiece to be machined.

Further, it is advantageous when the apparatus has at least a third drive unit, the third drive unit and the carrier unit being configured such that the carrier unit together with the machining heads is movable with the aid of the third drive unit in the direction of the workpiece support and in opposite direction. Alternatively or additionally, the at least two machining heads may be arranged next to one another in the carrier unit in a single row transverse to the transport direction of the workpiece to be machined. Further, the carrier unit may be oriented parallel to the workpiece support.

The third drive unit may comprise at least one motor-driven spindle drive. By way of the third drive unit, the carrier unit may in particular be moved toward the workpiece to compensate for wear of the tools, preferably when the machining heads are arranged below the workpiece support. When the machining heads are arranged above the workpiece support, both a compensation of the wear of the tools and an adjustment of the apparatus to the material thickness of the workpiece to be machined may be realized by a positioning of the carrier unit.

Further, it is advantageous when the tool carrier is connected to the first drive unit via a drive shaft. For shifting the tool carrier, the drive shaft, preferably with the aid of at least one needle bearing, may be mounted rotatably and movably in the shifting range along the first axis. Alternatively, at least a part of the drive shaft may be configured as a power take-off shaft. As a result, an easy shifting of the tool carrier relative to the carrier unit is possible.

Further, it is particularly advantageous when the shifting range has a length in the range from 2 mm to 60 mm, in particular a length in the range from 5 mm to 40 mm, preferably in the range from 10 mm to 20 mm. As a result, tolerances in the evenness of the flat workpieces to be machined may be leveled out in an easy manner. Such tolerances may occur in particular in the preprocessing of these workpieces, such as flame-cutting or laser cutting.

It is particularly advantageous when the planet wheels are directly engaged with the respective sun wheel or are engaged with the respective sun wheel via one intermediate wheel each. As a result, an easy and safe force transmission with a simple structure of the apparatus is possible.

Further, it is advantageous when the sun wheel is a sun gear wheel and when the intermediate wheel is an intermediate gear wheel and/or when the planet wheels are planet gear wheels. As a result, a safe positive force transmission is possible so that an exact control of the planetary heads is possible. In particular, no slip occurs as a result thereof, as is often the case when belt drives or friction wheels are used.

Further, it is particularly advantageous when the drive shaft is connected to the second drive unit via a positive gear stage, in particular via gear wheels. Alternatively, a direct drive may be provided for each planetary head. Both alternatives enable a particularly easy and safe drive of the planetary heads.

Further, it is advantageous when upon shifting of the tool carrier of a machining head in the shifting range along the first axis a shifting of the planet wheels relative to the sun wheel of the respective machining head takes place. As a result, a simple and space-saving structure of the apparatus is possible.

Further, it is advantageous when the tooth width of the planet gear wheels or the tooth width of the intermediate gear wheels is broader than the tooth width of the sun wheel by the adjusting range. As a result, the sun wheel, which usually has a large diameter, may be provided with a relatively narrow tooth width, wherein the planet gear wheels, which usually have a smaller diameter than the sun wheel, have a correspondingly larger tooth width so that as a result thereof space and material can be saved.

Further, the carrier unit with the machining heads may be arranged above the workpiece support so that the weight of the tool carrier and/or the drive shaft may exert a force on the tool carrier in the direction of the workpiece support. As a result, a pressure force for machining by the tools is generated by the weight of the tool carrier, the drive shaft and the tools. Thus, it is possible that the second drive unit does not have to exert any or only a small additional pressure force for machining the workpiece.

Alternatively, it is possible to arrange the tool carrier and/or the carrier unit below a workpiece receiving area or a workpiece transport plane of the workpiece support. As a result, the underside of the workpiece may be machined with the aid of the tools. The pressure force is then preferably generated by the second drive unit.

Further, it is advantageous when the apparatus has a second sensor unit that is configured to detect the surface course of a workpiece resting on the workpiece support. As a result, the control unit may control the second drive units depending on the course of the surface of the workpiece to be machined.

Further, it is advantageous when the machining heads are arranged such that the circles of action of the tools of adjacent machining heads overlap. As a result, a full-surface machining of the workpieces over the entire machining width is possible, without gaps occurring, so that several rows of planetary heads arranged behind one another can be done without and only one planetary head row is required. As a result, the apparatus may be structured in a very space-saving manner.

Further, it is advantageous when each planetary head has at least two, in particular three, four or five tools and thus correspondingly many planet wheels. As a result, a simple structure of the apparatus is possible.

It is particularly advantageous when at least one position detecting element is provided that is configured to detect at least the reaching of the end of the shifting range of at least one tool carrier remote from the tool carrier. The control unit may then control the third drive unit upon reaching the end of the shifting range remote from the tool carrier such that the carrier unit is moved away from a workpiece to be machined.

Alternatively or additionally, a third or fourth sensor unit may be provided, which determines a value of the drive power, the drive force and/or the drive torque of the first drive unit. The control unit may then compare the value determined by the third sensor unit with a preset limit value, in particular calculated on the basis of further operating parameters. Further, the control unit may control the second and/or third drive unit upon reaching or exceeding the limit value such that the distance of at least one tool carrier or all tool carriers relative to the workpiece support or to the workpiece is increased. As a result, an easy automated control of the second and/or third drive unit is possible.

Further features and advantages result from the following description of embodiments in connection with the enclosed Figures.

DETAILED DESCRIPTION

Figure 1:
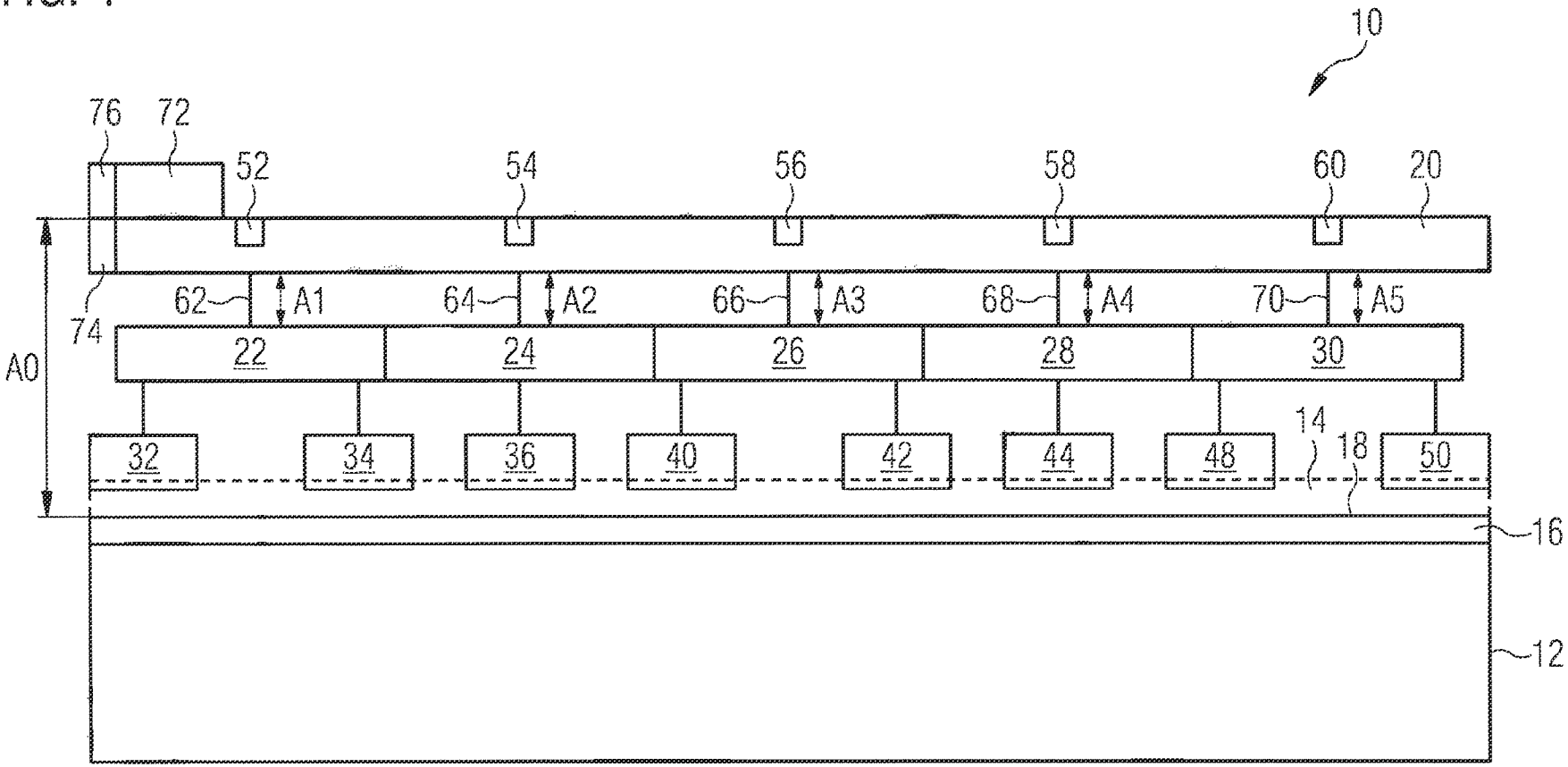
FIG. 1 shows a schematic illustration of an apparatus for machining flat workpieces according to a first embodiment.

FIG. 1 shows a schematic illustration of an apparatus 10 for machining flat workpieces 14 according to a first embodiment. The apparatus 10 comprises a machine frame 12 having a workpiece support 16 for supporting the workpiece 14. With the aid of the workpiece support 16, the workpiece 14 is held in a support plane 18 or transported in this plane. For this, the workpiece support 16 may in particular comprise a conveyor belt. The outline of the workpiece 14 is schematically illustrated with the aid of a broken line over the entire maximum machining width of the apparats 10. Workpieces 14 to be machined may however have a smaller width. In particular, also two or more workpieces 14 may be arranged next to each other on the workpiece support 16 so that these may be machined simultaneously.

The apparatus 10 further comprises a carrier unit 20 which is arranged movably relative to the machine frame 12 orthogonally to the support plane 18 with the aid of a drive unit 74. Several machining heads 22 to 30 that are configured as planetary heads 22 to 30 and comprise two tools 32 to 50 each are connected to the carrier unit 20. In other embodiments, also more than two, in particular three, four or five tools 32 to 50 per machining head 22 to 30 may be provided.

The apparatus 10 further comprises a first drive unit 72 for driving the machining heads 22 to 30, the machining heads 22 to 30 configured as planetary heads each having a fixed sun wheel and a tool carrier drivable with the aid of the first drive unit 72. The tool carriers are each mounted on the carrier unit 20 rotatably about a first axis perpendicular to the workpiece support 16 defined by the longitudinal axis of a drive shaft 62 to 70 of the respective machining head 22 to 30. The tool carrier carries two tools 32 to 50 each, which are mounted on the tool carrier eccentrically to the first axis rotatably about a second axis perpendicular to the support plane 18 and each time connected to the planet wheel. The planet wheel is gear-engaged with the sun wheel that is coaxial to the first axis. The tool carrier of the respective machining head 22 to 30 is arranged such that it is movable in a shifting range A1 to A5 along the first axis relative to the carrier unit 20.

The apparatus 10 further comprises second drive units 52 to 60, by which the tool carriers of the machining heads 22 to 30 are moved independently of one another in the direction of the arrows A1 to A5 along their respective shifting range. Thus, the tool carriers of all machining heads 22 to 30 are arranged movably along the respective first axis. As a result, the distance of the tools 32 to 50 relative to the support plane 18 or relative to the surface of the workpiece 14 to be machined may be set and in particular individually adapted to the course of the surface of the workpiece 14 to be machined. It is particularly advantageous when a control unit 76 controls the drive units 52 to 60 dependent on whether the workpiece 14 to be machined is already in the machining area of the respective machining head 22 to 30, in particular whether the workpiece 14 covers a preset percentage of for example 50% of the machining area of the respective machining head 22 to 30. Thus, it is guaranteed that the respective tool 32 to 50 is not arranged too low relative to the workpiece surface so that damage in particular to the tools 32 to 50 and the machining heads 22 to 30 is avoided. In the first embodiment, the tools 32 to 50 are abrasive tools 32 to 50 that have substantially cylindrical abrasive bodies. The abrasive bodies each comprise a plurality of abrasive discs that are arranged in radial planes including the cylinder axis and the axis of rotation of the cylindrical abrasive bodies. The arrangement of the abrasive discs is schematically illustrated in FIG. 2.

In the case of such abrasive tools 32 to 50, the machining head 22 to 30 is controlled with the aid of the second drive units 52 to 60 by the control unit 76 such that the abrasive discs or abrasive bodies are moved in the direction of the workpiece 14 to be machined so far that the abrasive discs are elastically deformed after a contact with the surface of the workpiece 14 to be machined. Preferably, the tools 32 to 50 are moved in the direction of the workpiece 14 so far that the abrasive discs of the tools 32 to 50 protrude with a preset depth into the area of the workpiece 14, preferably with a depth in the range from 1 mm to 5 mm, in particular 3 mm, when no workpiece 14 would be present in the machining area of the tool 32 to 50. Thus, the tools 32 to 50 have a distance to the surface of the workpiece 14 to be machined in the range from −1 mm to −5 mm, in particular −3 mm.

Figure 3:
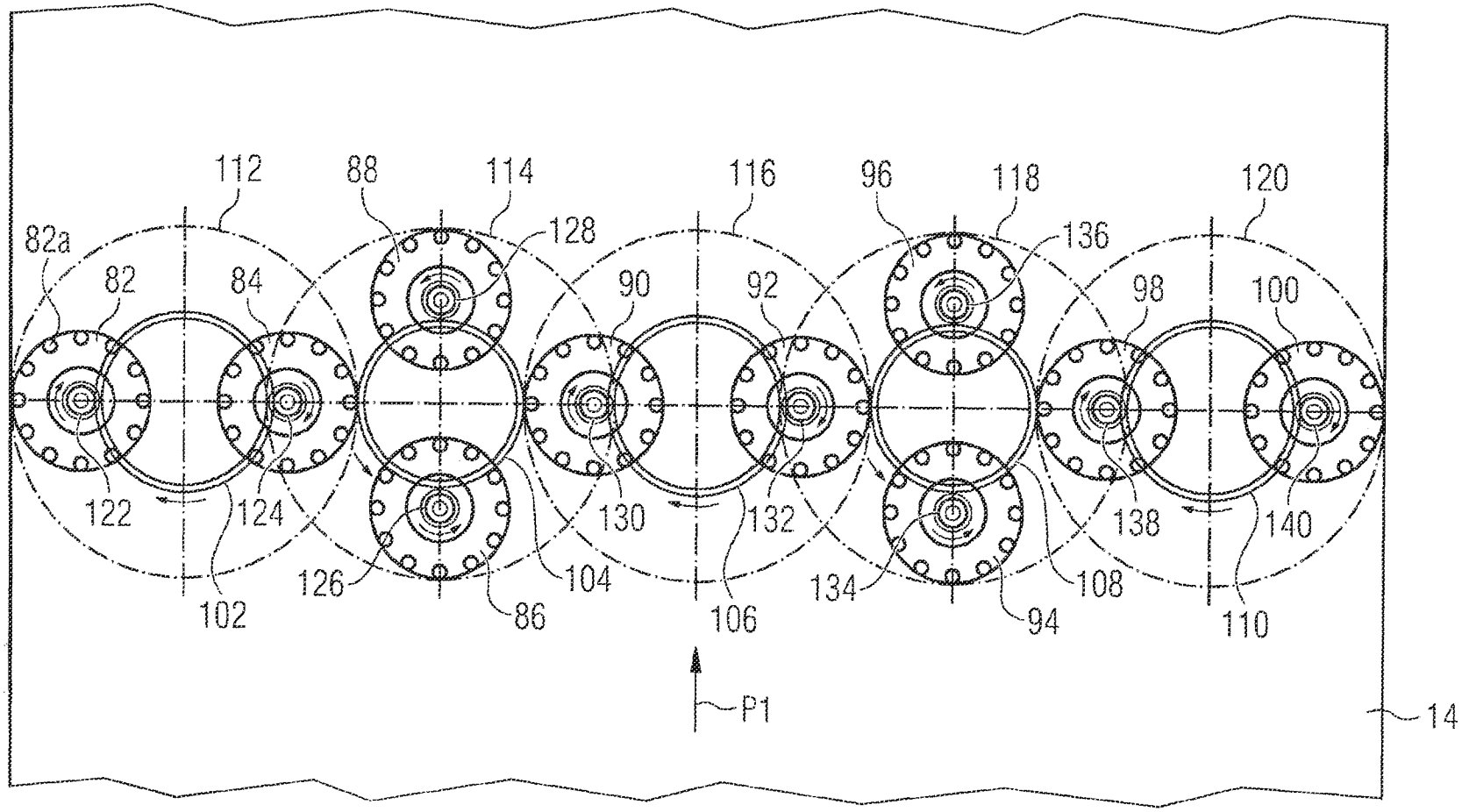
FIG. 3 shows a schematic illustration of machining areas of the apparatus according to FIG. 1 with second tools for machining the workpiece.

In the case of knock-off tools, such as those for example schematically illustrated in FIG. 3, the tools 82 to 90 are approached to the workpiece 14 to be machined by the control unit 76 with the aid of the drive units 52 to 60 so far that they preferably have a distance in the range from 0 mm to 0.5 mm to the surface of the workpiece 14. As a result, in particular slag present on the surface of the workpiece 14 to be machined can be knocked off.

Figure 2:
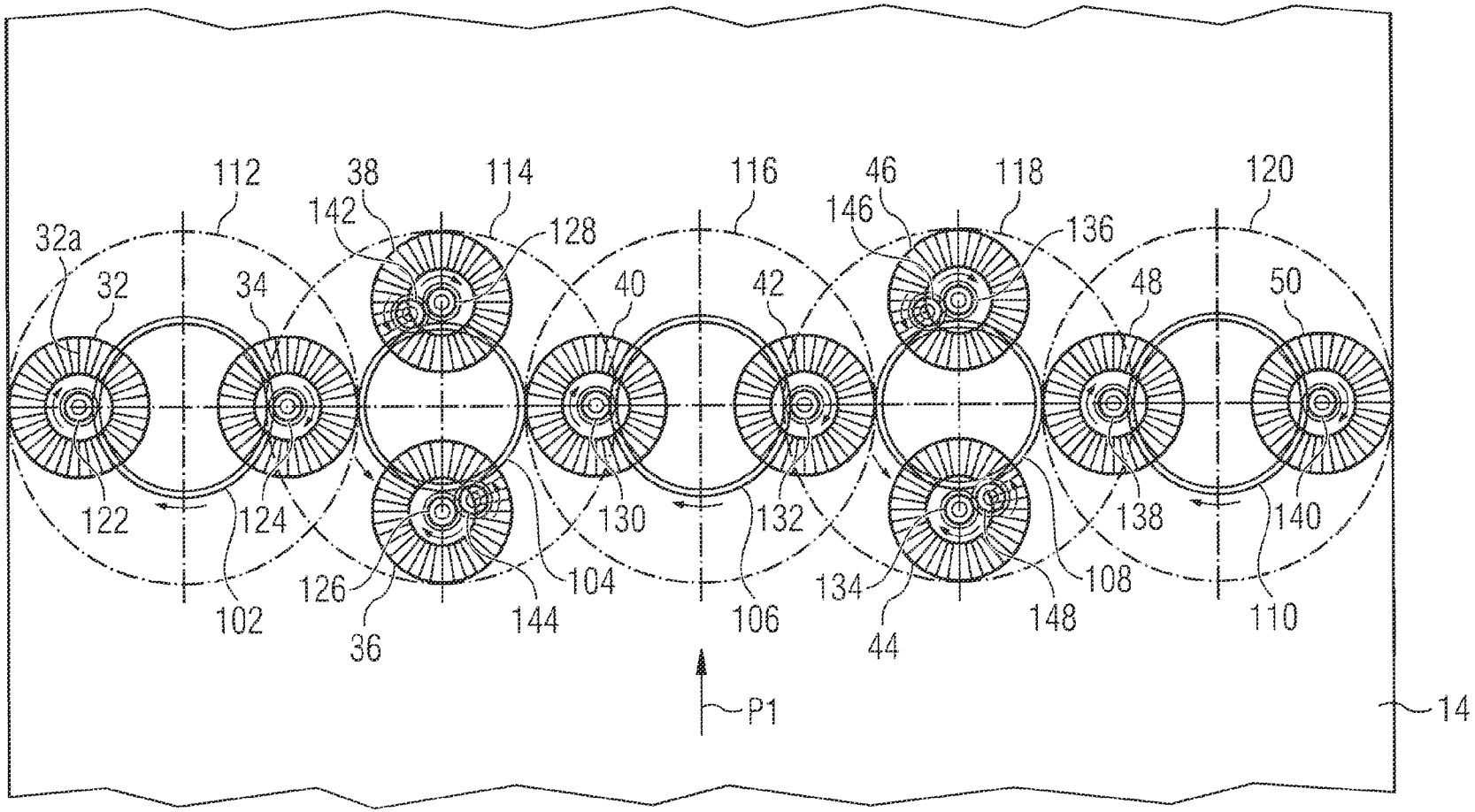
FIG. 2 shows a schematic illustration of machining areas of the apparatus according to FIG. 1 with first tools for machining the workpiece.

FIG. 2 shows a schematic top view of the tools 32 to 50 of the machining heads 22 to 30 of the apparatus according to FIG. 1 and of the workpiece 14, the carrier unit 20 and the tool carriers of the machining heads 22 to 30 not being illustrated. In FIG. 2, the machining areas 112 to 120 of the machining heads 22 to 30 are illustrated by dash-dotted lines. As already mentioned, the tools 32 to 50 each comprise several abrasive discs, of which one abrasive disc at the tool 32 is identified with the reference sign 32*a*. Further, in FIG. 2 the sun wheels 102 to 110 of the machining heads 22 to 30 are illustrated, as well as the planet wheels 122 to 140 engaged with the sun wheels 102 to 110, the planet wheels 126, 128, 134, 136 being gear-engaged with the respective sun wheel 104, 108 via intermediate wheels 142 to 148. The tool carriers of the machining heads 22, 26 and 30 are driven clockwise by the drive unit 72 in a first direction of rotation, and the tool carriers of the machining heads 24 and 28 are driven anti-clockwise in a second direction of rotation. By way of the intermediate wheels 142 to 148, it is achieved that all tools 32 to 50 are driven clock-wise. Upon movement of the tool carriers of the machining heads 22 to 30, the tools 32 to 50 mesh so that the machining areas 112 to 120 partially overlap. The workpiece 14 is guided past the machining heads 22 to 30 in the direction of the arrow P1 so that the entire surface of the workpiece 14 is machined by the tools 32 to 50 of the machining heads 22 to 30. The directions of rotation of the tool carriers and of the tools 32 to 50 are indicated by the arrows of direction in FIGS. 2, 3 and 6. The directions of rotation of the tools 32 to 50 are the same so that in the case of rotation-direction-dependent tools 32 to 50 only one tool type is required. In other embodiments, also all tools 32 to 50 may be engaged with the respective sun wheel 102 to 110 via intermediate wheels 142 to 148 or alternatively directly. Embodiments in which a part of the tools 32 to 50 of a machining head 22 to 30 is engaged with the sun wheel 102 to 110 of the machining head 22 to 30 via an intermediate wheel 142 to 148 and another part of the tools 32 to 50 of the machining head 22 to 30 is directly engaged with the sun wheel 102 to 110 are likewise possible.

FIG. 3 shows a schematic illustration of the machining areas 112 to 120 of the apparatus 10 according to FIG. 1 with second tools 82 to 100 for machining the workpiece 14. The tools are knock-off tools 82 to 100, which each have a cylindrical basic body from which several knock-off pins 82*a* or knock-off cylinders project in the direction of the workpiece 14 to be machined. The knock-off pins 82*a* in particular serve to knock-off slag or other residues, which in particular remain on the surface of the workpiece 14 during cutting. In the case of different directions of rotation of adjacent machining heads 22 to 30, the tools 32 to 50, 82 to 100 have in the case of a direct engagement of the planet wheels 122 to 140 with the respective sun wheel 102 to 110 given a corresponding movement of the workpiece 14 in the direction of the arrow P1, about the same machining speed of the machining areas of the individual tools 32 to 50, 82 to 100 in all parts of the machining area 112 to 120 of the respective machining head 22 to 30. By selecting the direction of rotation, thus the cutting, brushing or knock-off speed may be influenced or set. With the aid of intermediate wheels 142 to 148, thus the direction of rotation of all or some tools 32 to 50, 82 to 100 may be adapted to the procedural requirements for machining the workpiece 14.

Figure 4:
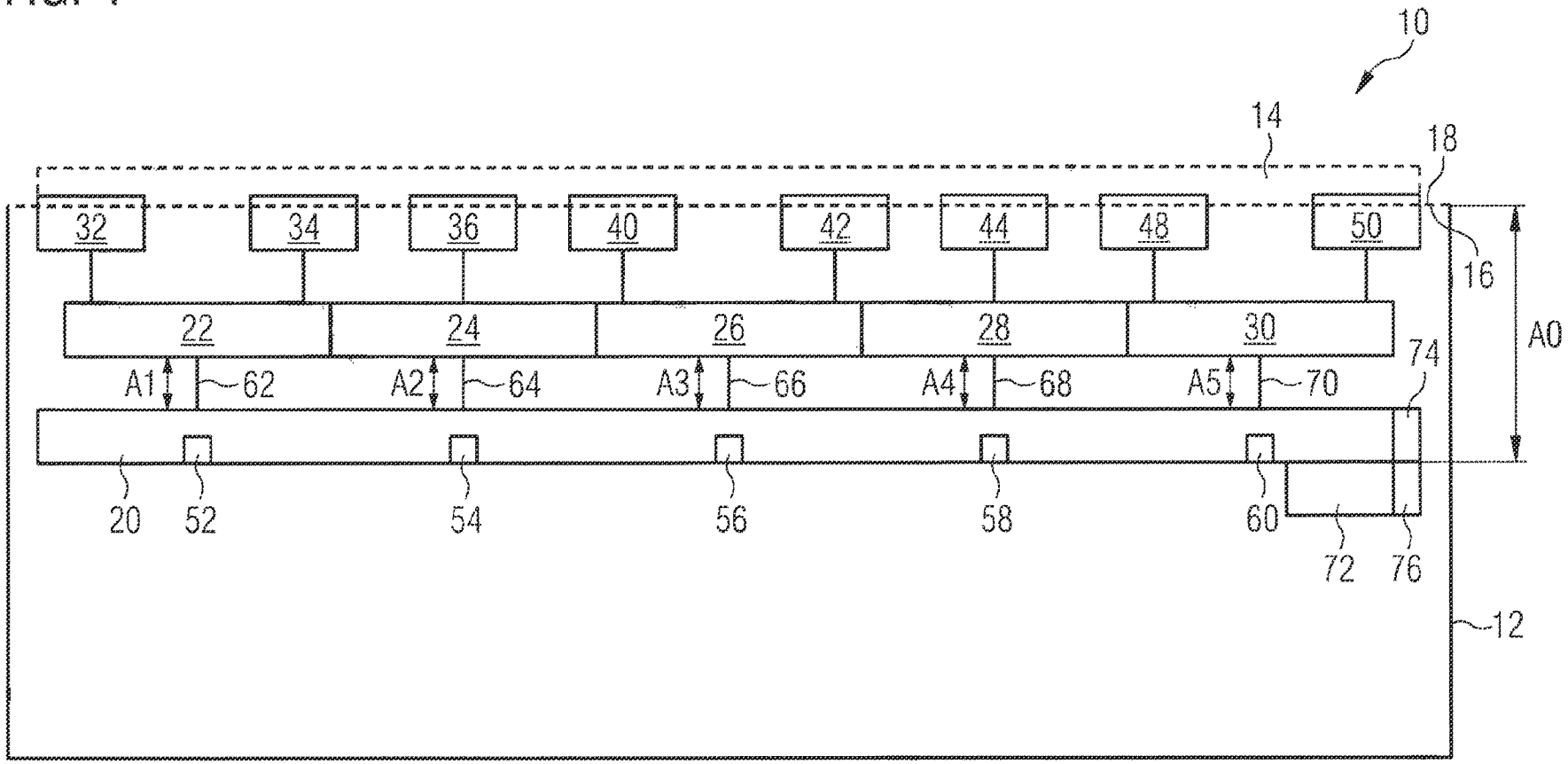
FIG. 4 shows a schematic illustration of an apparatus for machining flat workpieces according to a second embodiment.

FIG. 4 shows a schematic illustration of an apparatus 200 for machining flat workpieces 14 according to a second embodiment. Elements having the same structure or function are identified with the same reference signs. The same applies to the further embodiments described below.

In contrast to the apparatus 10 according to FIG. 1, the tools 32 to 50 of the apparatus 200 contact the workpiece 14 on its underside. This enables an easy machining of the underside of the workpiece 14 with the aid of the tools 32 to 50. In particular, in the case of the apparatus 200, the adjustment of the position of the machining heads 22 to 30 dependent on the tool thickness 14 or the workpiece height is omitted. The movement of the carrier unit 20 in the direction of the workpiece 14 or away from the workpiece 14 with the aid of the drive unit 74 in particular is only done for compensation of wear of the tools 32 to 50. The remaining structure and the function of the apparatus 200 correspond to the apparatus 10 according to FIG. 1.

Figure 5:
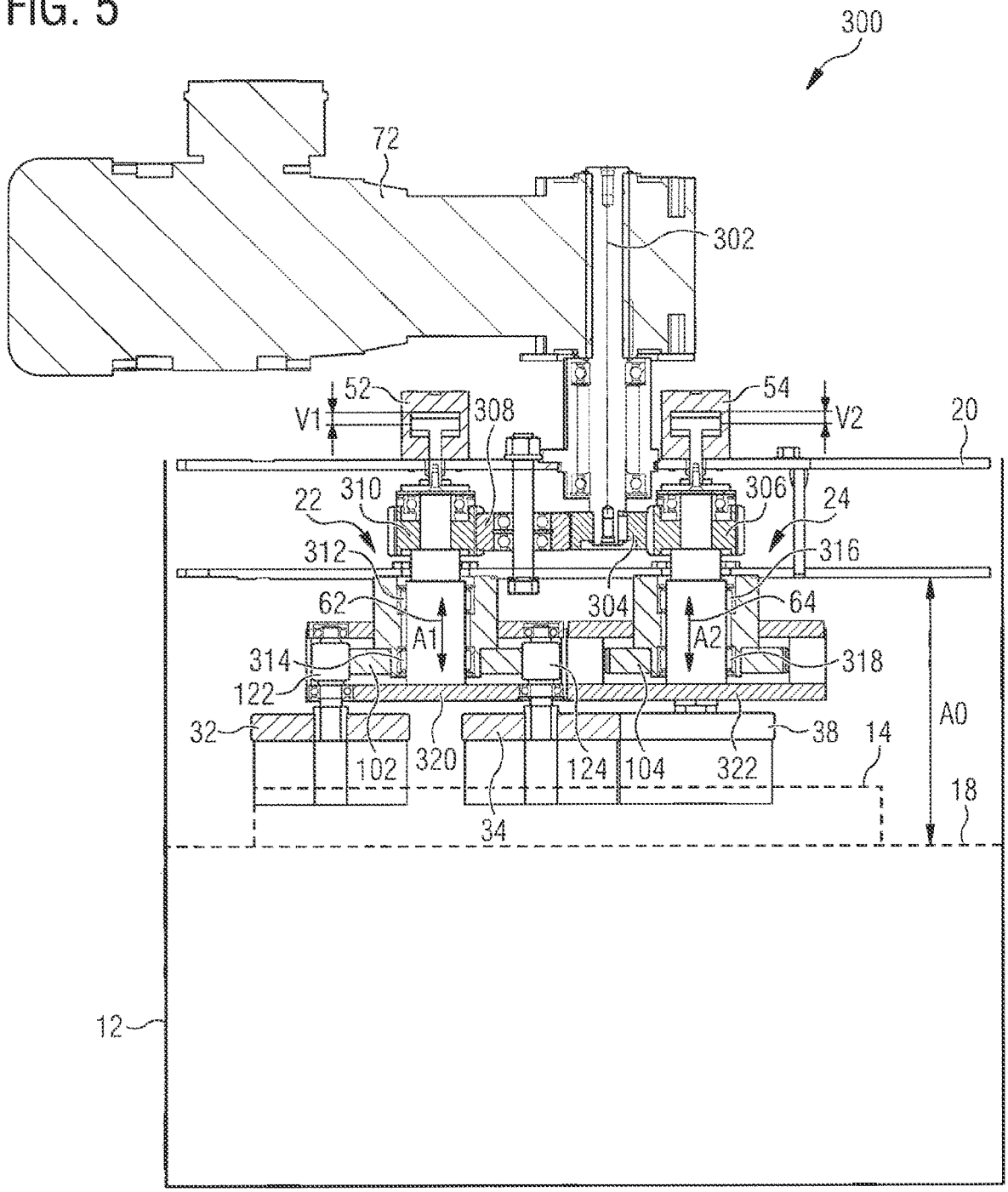
FIG. 5 shows a schematic sectional illustration of an apparatus for machining flat workpieces according to a third embodiment.

FIG. 5 shows a schematic sectional illustration of an apparatus 300 for machining flat workpieces 14 according to a third embodiment. In contrast to the apparatus according to FIG. 1, the apparatus 300 has only two machining heads 22, 24 arranged next to each other. The drive unit 72 designed as an electric motor drives a rotatably mounted drive shaft 302, wherein a drive pinion 304 is connected to the drive shaft 302 in a rotationally fixed manner. The drive pinion 304 is directly engaged with a gear wheel 306 connected to the drive shaft 64 in a rotationally fixed manner and via an intermediate gear wheel 308 with a gear wheel 310 connected to the drive shaft 62 in a rotationally fixed manner. A tool carrier 320 in which the tools 32, 34 are rotatably mounted together with the planet wheel 122, 124 is connected to the drive shaft 62 in a rotationally fixed manner. In the same manner, a tool carrier 322 of the second machining head 24 is connected to the drive shaft 64 in a rotationally fixed manner, wherein the tools 36, 38 as well as the planet wheels 126, 128 being rotatably mounted in this tool carrier 324. For the sake of clarity, not all cut elements are illustrated in a hatched manner. Thus, in particular the shafts 62, 62, 302 and the pistons of the drive units 52, 54 are not hatched. The tool carrier 320 is arranged offset by 90° about its axis of rotation relative to the tool carrier 322 so that the tools 32 to 38 mesh upon movement of the tool carriers 320, 322.

Figure 12:
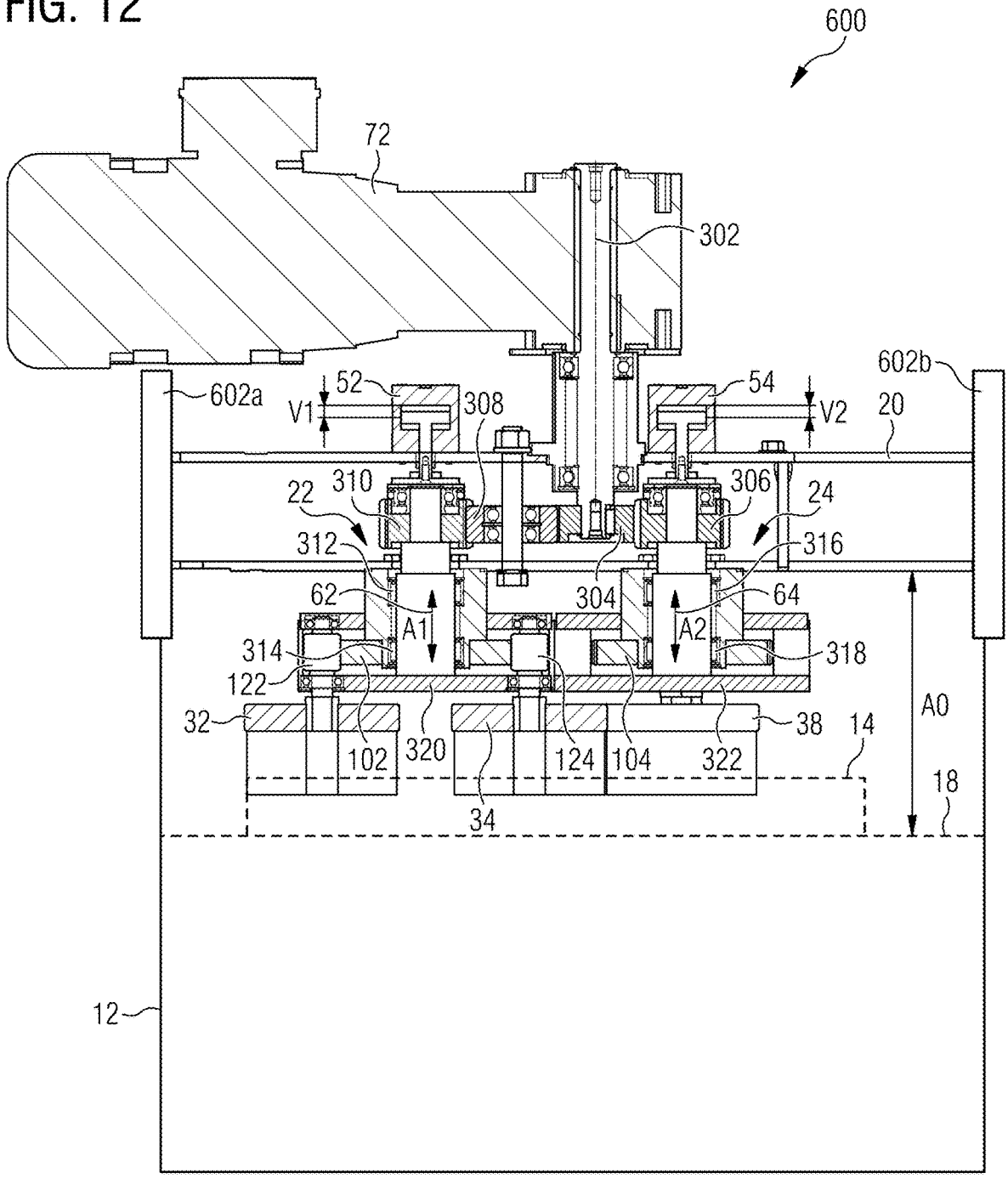
FIG. 12 shows a schematic sectional illustration of an apparatus for machining flat workpieces according to a fifth embodiment.

The planet gear wheels 122, 124 are engaged with the sun wheel 102 arranged in a rotationally fixed manner and roll upon the sun wheel 102 given a rotation of the tool carrier 320. In the same manner, the planet wheels 126, 128 roll upon the sun wheel 104 upon rotation of the tool carrier 322 so that the tools 36, 38 are moved on a planet path around the axis of rotation of the drive shafts 62, 64 and in doing so perform a rotation themselves, as indicated by the arrows in FIG. 6. FIG. 12 illustrates an embodiment 600 of the apparatus having at least one third drive unit 602*a*, 602*b*, wherein the carrier unit 20 is movable relative to the support plane 18 so that the distance A0 of the machining heads 22, 24 and thus of the tools 32 to 38 to the support plane 18 is adjustable and thus may in particular be adapted to the thickness or the height of the workpiece 14 to be machined. With the aid of the second drive units 52, 54 configured in this embodiment as pneumatic drive units, each of the machining heads 22, 24 is movable independently of the position of the other machining head 22, 24 along the longitudinal axis of the drive axes 62, 64 so that the distance of the respective machining head 22, 24 to the machining plane 18 is adjustable depending on the course of the surface to be machined of the workpiece 14 to be machined. In particular, the respective machining head 22, 24 may then be lowered to the workpiece 14 when the workpiece 14 enters the machining area 112, 114 of the respective machining head 22, 24 and in particular occupies a preset portion of the machining area 112, 114.

The stroke of the piston of the pneumatic cylinder of the second drive units 52, 54 delimits the shifting range of the tool carriers 320, 322 and thus of the tools 32 to 38. In FIG. 5, the pistons of the pneumatic cylinders are illustrated in the middle position. The sum of the possible upward stroke of the piston and the possible downward stroke of the piston is the length of the possible shifting range V1, V2. The shifting range V1, and V2 has a length in the range from 1 mm to 60 mm, in particular in the range from 20 mm to 40 mm. In general, the shifting range of the second drive units 52, 54 delimits the shifting range. At least a third sensor may be provided, which detects the end position of the respective second drive unit 52, 54 that is remote from the support plane 18 or the reaching of such an end position of the drive shaft 62, 64. Based on a sensor information of the sensor, the control unit 76 may control the drive unit 74 such that the distance between the carrier 20 and the support plane 18 is increased. Alternatively or additionally to the third sensor, a fourth sensor may be provided that detects the motor current and/or the torque of the first drive unit 72 and transmits a sensor information to the control unit 76. When exceeding a preset limit value, the control unit 76 may control the drive unit 74 such that the distance between the carrier 20 and the support plane 18 is increased.

Figure 6:
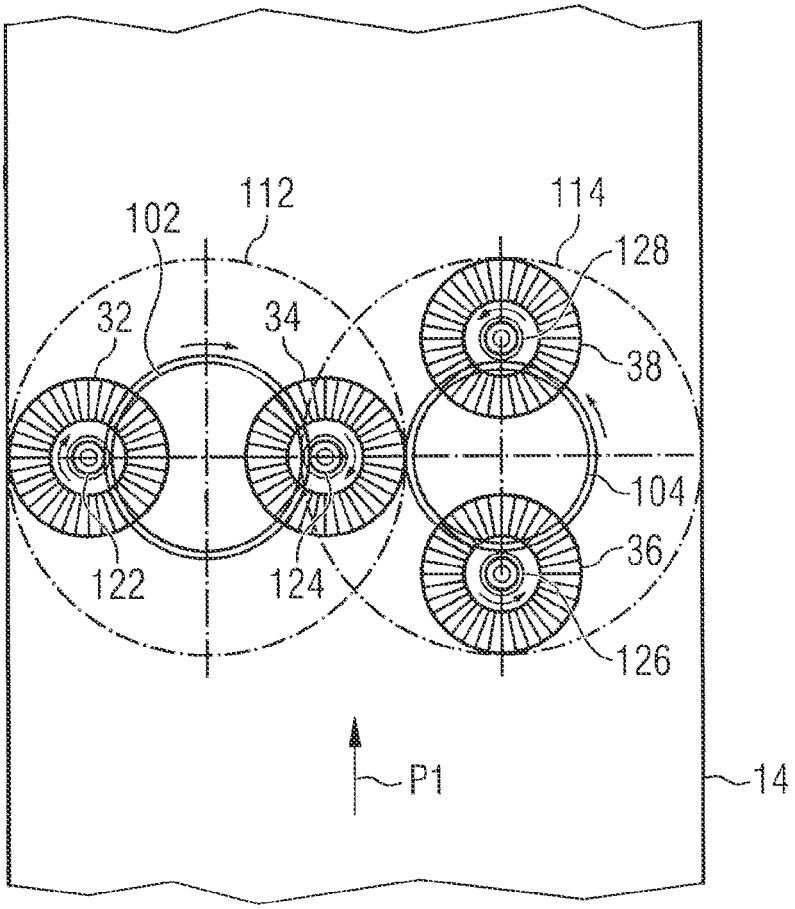
FIG. 6 shows a schematic illustration of machining areas of the apparatus according to FIG. 5.

FIG. 6 shows a schematic illustration of the machining areas 112, 114 of the apparatus 300 according to FIG. 5. In contrast to the illustration according to FIG. 2, the directions of rotation of the tools 32 to 38 of adjacent machining heads 22, 24 are different. In other embodiments, however, likewise an intermediate wheel may be provided between the sun wheel 102, 104 and the planet wheels 122 to 128 of a machining head 22, 24 so that the axis of rotation of all tools 32 to 38 is then the same. As an alternative to the grinding tools 32 to 38 illustrated, also other tools such as brushing tools or knock-off tools 82, 84 may be used in all embodiments.

Figure 7:
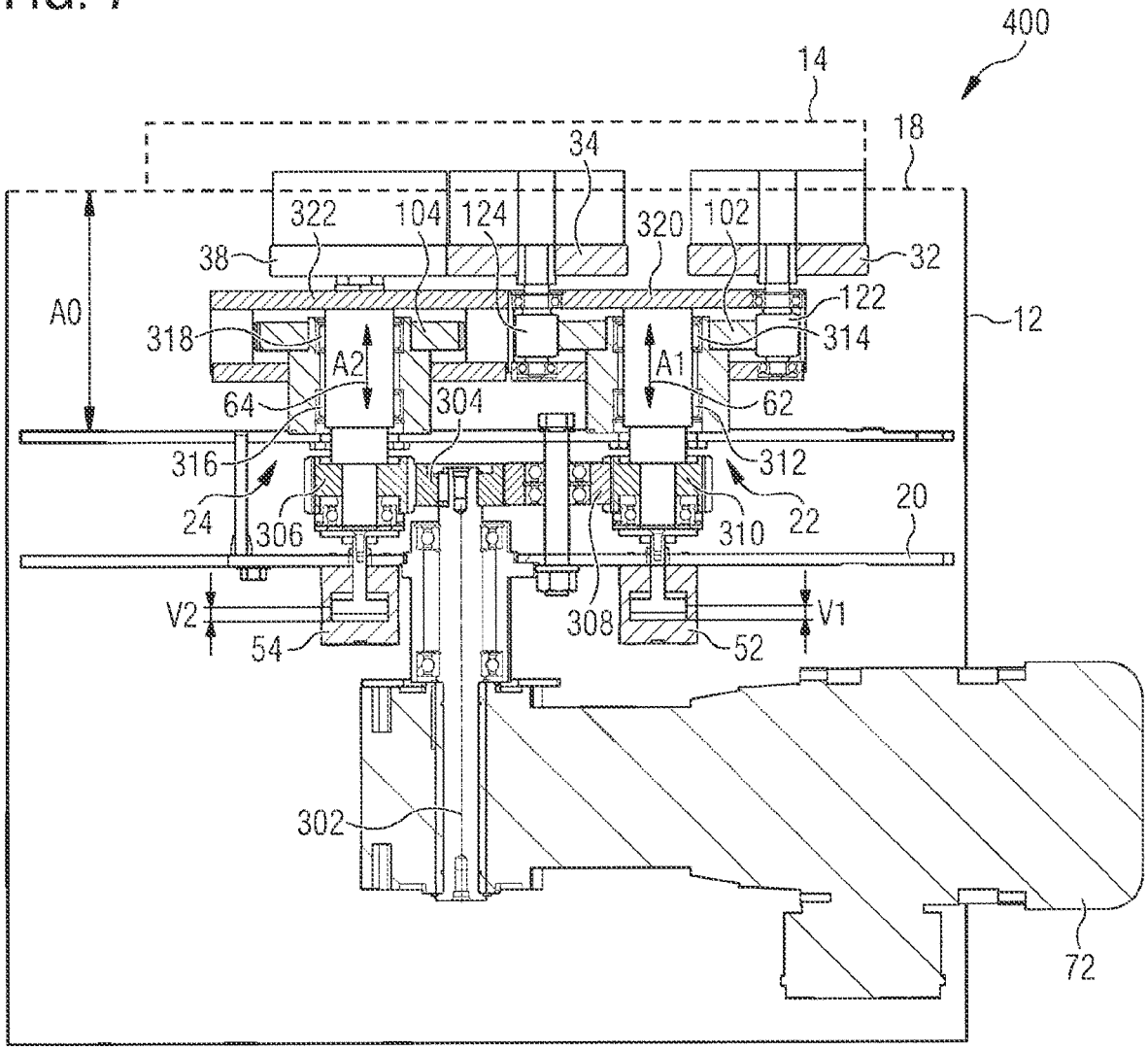
FIG. 7 shows a schematic sectional illustration of an apparatus for machining flat workpieces according to a fourth embodiment.

FIG. 7 shows a schematical sectional illustration of an apparatus 400 for machining flat workpieces 14 according to a fourth embodiment. In contrast to the third embodiment according to FIG. 5, the tools 32 to 38 contact the underside of the workpiece 14 to be machined. The remaining structure and function of the apparatus 400 corresponds to the structure and the function of the apparatus 300 according to FIG. 5.

Figure 8:
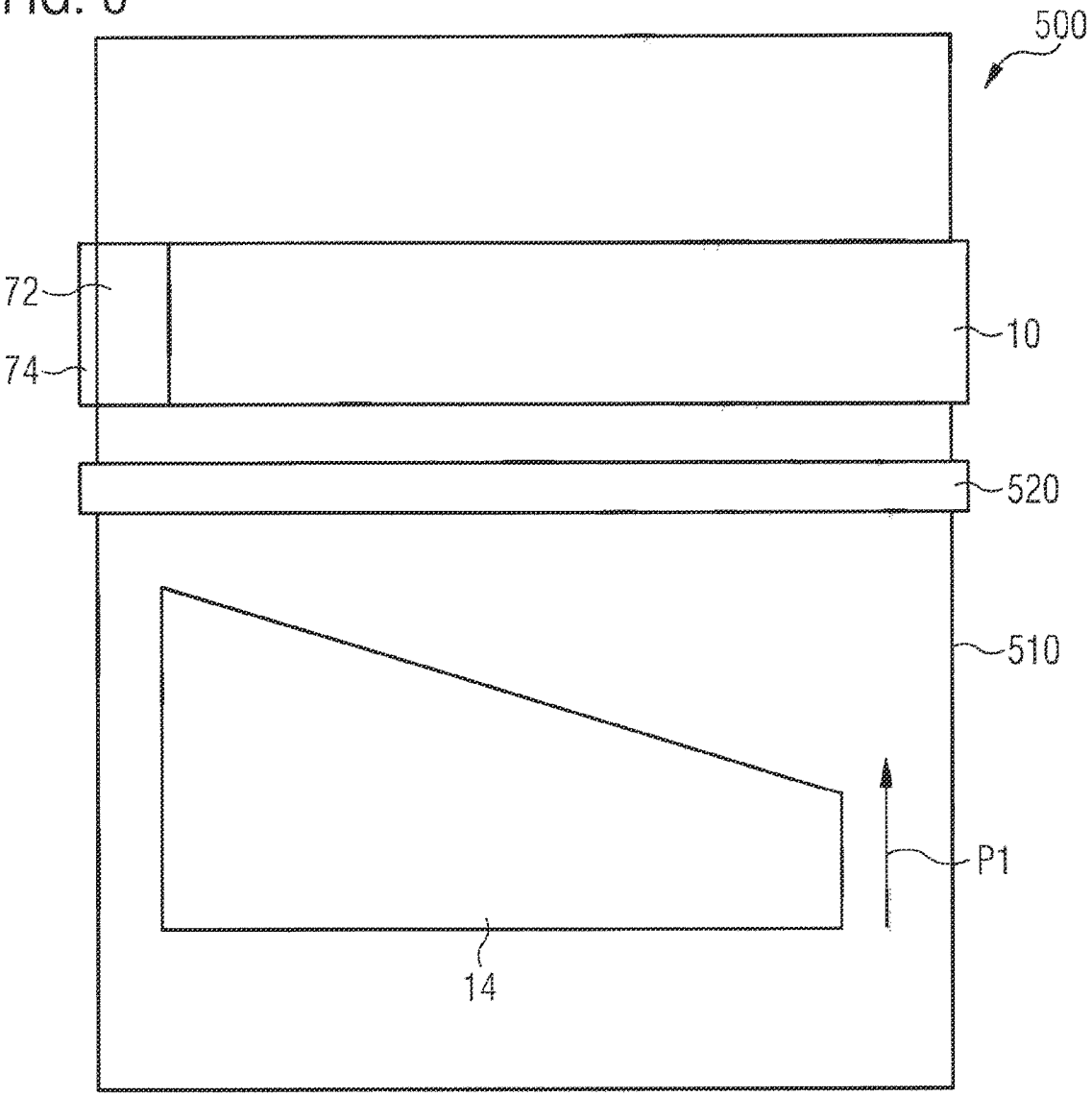
FIG. 8 shows a schematic top view of an arrangement for machining flat workpieces.

FIG. 8 shows a schematic top view of an arrangement 500 for machining flat workpieces 14. The arrangement 500 comprises a conveyor unit 510 designed as a conveyor belt for the transport of the workpiece 14 in the direction of the arrow P1 past the apparatus 10 for machining the workpiece 14. In transport direction P1 ahead of the apparatus 10, i.e. upstream of the apparatus 10, a sensor unit 520 that detects at least the arrival of the front edge of the workpiece 14 and generates at least a corresponding sensor information is arranged. In other embodiments, the sensor unit 520 may additionally or alternatively also detect the side edges and the rear edge of the workpiece 14. The generated sensor information is transmitted to the control unit 76 which then controls the second drive units 52 to 60 depending on the signal of the sensor unit 520.

The sensor unit 520 may comprise light barriers, light sensors, laser distance measuring units, at least one camera, preferably a line camera, at least one inductive sensor and/or at least one Reed contact, mechanical switches, in particular switch rollers, ultrasound sensors, in particular ultrasound distance measuring sensors. The sensor unit 520 is preferably configured such that it may detect any arbitrary shape and/or position of the workpiece 14. Based thereon, the control unit 76 may select specific areas and may control the second drive units 52 to 60 such that the machining heads 22 to 30 machine selected areas of the surface of the workpiece 14.

In other embodiments, also the provision of the sensor unit 520 can be dispensed with when the geometry of the workpiece 14 is provided via the input and/or the transmission of corresponding data to the control unit 76. It is particularly advantageous when the control unit 520 determines for example with the aid of several laser distance measuring units the course of the surface of the workpiece 14 to be machined in the detection area of the sensor unit 520, the respective detection area in the transport direction P1 corresponding in the following to the machining area 112 to 120. As a result, an easy and exact control of the second drive units 52 to 60 depending on the course of the surface to be machined in the corresponding machining area 112 to 120 is possible, said course being detected with the aid of the sensor unit 520.

In other embodiments, instead of the apparatus 10 also one of the apparatuses 200, 300 or 400 may be used, the sensor unit 520 scanning the underside of the workpiece 14 to be machined in the embodiments 200, 400.

Figure 9:
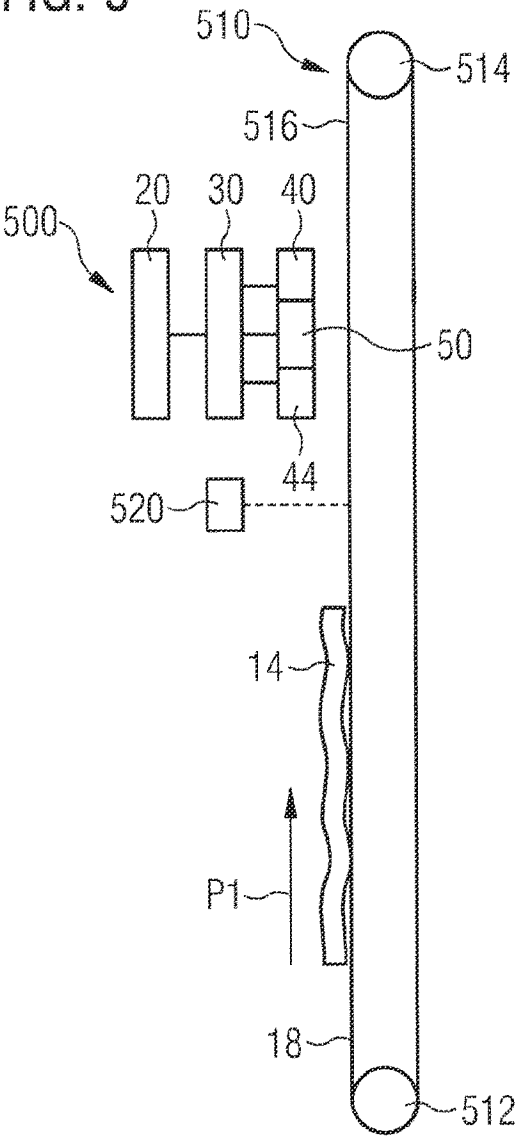
FIG. 9 shows a schematic side view of the arrangement according to FIG. 8.

FIG. 9 shows a schematic side view of the arrangement 500 according to FIG. 8. The conveyor unit 510 comprises in the present embodiment two deflection rollers 512, 514 and a conveyor belt 516 guided over these deflection rollers 512, 514. In the area of the apparatus 10, the conveyor belt 516 may also be supported and/or guided by counter pressure elements. As a result, a safe machining of the workpiece 14 to be machined is made possible.

Figure 10:
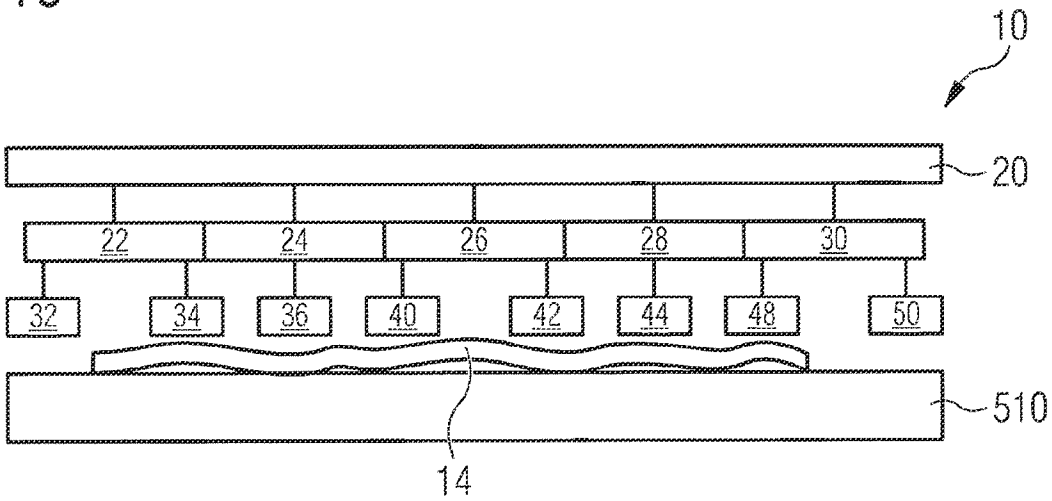
FIG. 10 shows a first schematic front view of the arrangement according to FIG. 8.
Figure 11:
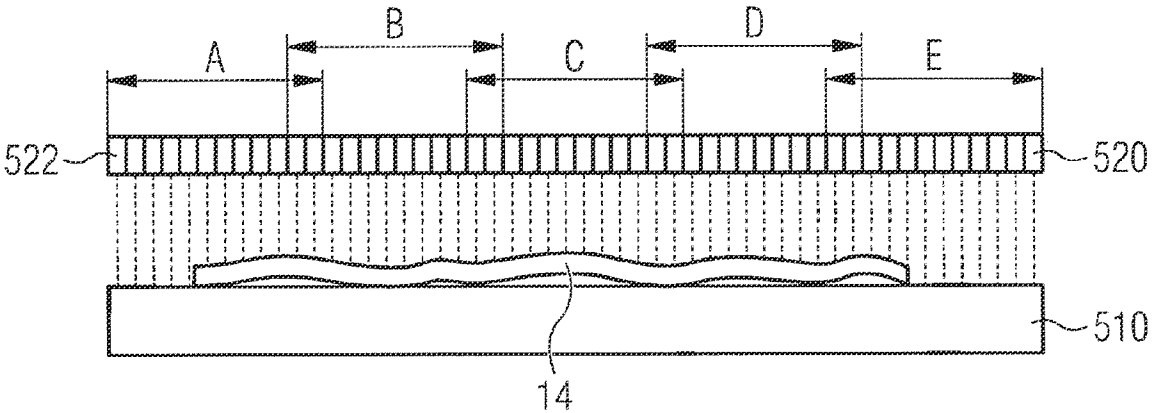
FIG. 11 shows a second schematic front view of the arrangement of FIG. 8.

FIG. 10 shows a first schematic front view of the arrangement 500 according to FIG. 8, the sensor unit 520 having been omitted. FIG. 11 shows a second schematic front view of the arrangement 500 according to FIG. 8, wherein only the sensor unit 520 and not the apparatus 10 is illustrated. The sensor unit 520 comprises a plurality of sensor elements, which are configured in the embodiment as laser distance measuring units and of which one is identified with 522. In the embodiment according to FIGS. 8 to 11, each time twelve sensor elements 522 are allocated to the machining area 112 to 120, wherein the detection areas in FIG. 11 are identified with A to E. Preferably, the detection area A is allocated to the machining head 22, the detection area B to the machining head 24, the detection area C to the machining head 26, the detection area D to the machining head 28, and the detection area E to the machining head 30. As can clearly be seen from FIGS. 9 to 11, the workpiece 14 to be machined has an uneven surface that may be detected with the aid of the sensor unit 520. In other embodiments, also more or less sensor elements 522 may be provided per machining head 22 to 30, in particular one sensor element 522 per machining head 22 to 30 or two sensor elements 522, three sensor elements 522 or four to ten sensor elements 522 per machining head 22 to 33.

As already mentioned, the directions of rotation and thus the machining speeds of the tools 32 to 50, 82 to 100 may be influenced by the provision or non-provision of intermediates wheels 142 to 148. In other embodiments, also the respective sun wheel 102 to 110 of the machining heads 22 to 30 may be driven with the aid of a further drive unit. As a result, the rotational speed of the planet wheels 122 to 140 and thus of the tools 32 to 50, 82 to 100 may be set independently of the rotational speed of the machining heads 22 to 30.

What is claimed is:

1. An apparatus for machining flat workpieces, comprising a machine frame including a workpiece support and at least one carrier unit positionable relative to the workpiece support, a first and at least a second machining head, each machining head being connected to the carrier unit and each machining head comprising a tool carrier that is mounted on the carrier unit rotatably about a first axis perpendicular to the workpiece support and that carries at least one tool that is mounted on the tool carrier eccentrically to the first axis rotatably about a second axis perpendicular to the workpiece support and is connected to a planet wheel that is gear-engaged with a sun wheel that is coaxial to the first axis, the tool carriers of the machining heads being drivable together by at least a first drive unit, characterized in that the tool carrier of the first machining head is arranged such that it is movable in a first shifting range along the first axis relative to the carrier unit, and that the tool carrier of the second machining head is arranged such that it is movable in a second shifting range along the first axis relative to the carrier unit.

2. The apparatus according to claim 1, characterized in that a second drive unit is allocated to each machining head, said second drive unit being configured to shift the tool carrier of the respective first or second machining head in the respective first or second shifting range, that a first sensor unit is provided which is configured to detect the presence and/or the arrival and/or the distance of a workpiece surface to be machined to the workpiece support in a machining area of the respective machining head and to generate a corresponding sensor information and to transmit it to a control unit, that the control unit is configured to control the second drive unit based on the sensor information such that at least a part of the tool of the respective first or second machining head contacts the workpiece surface to be machined that is present in the machining area.

3. The apparatus according to claim 2, characterized in that the first sensor unit predetermines a course of the workpiece surface and/or a shape of a portion of the workpiece surface to be machined entering the machining area, and that the control unit is configured to control the second drive unit based on the predetermined course, the control unit preferably being configured to control the second drive unit such that a preset distance between the tool carrier and the workpiece surface to be machined is maintained at the preset distance as the workpiece enters the machining area.

4. The apparatus according to claim 2, characterized in that the apparatus has at least a third drive unit, that the third drive unit and the carrier unit are configured such that the carrier unit together with the machining heads is movable in the direction of the workpiece support and in opposite direction, and/or that the at least two machining heads are arranged next to one another in the carrier unit in a single row transverse to a transport direction of the workpiece to be machined, wherein the carrier unit is preferably oriented parallel to the workpiece support.

5. The apparatus according to claim 1, characterized in that the tool carrier is connected to the first drive unit via a drive shaft, wherein for shifting the tool carrier the drive shaft is mounted rotatably preferably with the aid of at least one needle bearing and movably in the first or second shifting range along the first axis.

6. The apparatus according to claim 1, characterized in that each of the first and second shifting ranges has a length in a range from 2 mm to 60 mm.

7. The apparatus according to claim 2, characterized in that the planet wheels are directly engaged with the respective sun wheel or via a respective intermediate wheel with the respective sun wheel.

8. The apparatus according to claim 7, characterized in that the sun wheel is a sun gear wheel, that the intermediate wheel is an intermediate gear wheel and/or that the planet wheels are planet gear wheels.

9. The apparatus according to claim 1, characterized in that a drive shaft is connected to the first drive unit via a positive gear stage comprising gear wheels.

10. The apparatus according to claim 1, characterized in that upon shifting the tool carrier of a respective first or second machining head in the respective first or second shifting range along the first axis, a shifting of the planet wheels relative to the sun wheel of the respective machining head takes place.

11. The apparatus according to claim 8, characterized in that the tooth width of the planet gear wheels or the tooth width of the intermediate gear wheels is broader than the tooth width of the sun gear wheel by the respective first or second shifting range.

12. The apparatus according to claim 1, characterized in that the carrier unit with the machining heads is arranged above the workpiece support and that the weight of the respective tool carrier and/or of a drive shaft exerts a force on the respective tool carrier in the direction of the workpiece support.

13. The apparatus according to claim 1, characterized in that the respective tool carrier is arranged below a workpiece receiving area or a workpiece transport plane of the workpiece support.

14. The apparatus according to claim 4, characterized in that at least one position detection element is provided that is configured to detect at least the reaching of the end of a respective first or second shifting range of at least one tool carrier remote from the tool carrier, the control unit controlling the third drive unit upon reaching the end of the respective first or second shifting range remote from the tool carrier to move the carrier unit away from a workpiece to be machined.

15. The apparatus according to claim 2, characterized in that at least a third sensor unit is provided that determines a value of the drive power, the drive force and/or the drive torque of the first drive unit, and that the control unit compares the value determined by the third sensor unit with a preset limit value, in particular calculated on the basis of further operating parameters, and that the control unit when reaching or exceeding the limit value controls the second and/or the third drive unit such that the distance of at least one tool carrier or all tool carriers to the workpiece support or to the workpiece is increased.

* * * * *